US005209177A

United States Patent [19]

Granie et al.

[11] Patent Number: 5,209,177

[45] Date of Patent: May 11, 1993

[54] PONTOON-TYPE BOAT

[75] Inventors: Charles L. Granie, Columbia; James W. Filiatreault, Lexington, both of S.C.

[73] Assignee: Outboard Marine Corporation, Waukegan, Ill.

[21] Appl. No.: 907,911

[22] Filed: Jul. 2, 1992

[51] Int. Cl.[5] ..... B63B 17/00

[52] U.S. Cl. ..... 114/343; 114/361

[58] Field of Search ..... 114/61, 290, 291, 343, 114/362, 364, 56, 361

[56] References Cited

U.S. PATENT DOCUMENTS

| | | | |
|---|---|---|---|
| D. 197,363 | 1/1964 | Stevens | D71/1 |
| D. 201,109 | 5/1965 | Stevens | D71/1 |
| D. 245,902 | 9/1977 | Rogers | D12/62 |
| D. 264,573 | 5/1982 | Rogers | D12/310 |
| D. 267,866 | 2/1983 | Parsons | D12/311 |
| 2,950,699 | 8/1960 | Ogden et al. | 114/61 |
| 3,045,263 | 7/1962 | Blachly | 9/1 |
| 3,052,896 | 9/1962 | Beach | 114/362 |
| 3,126,856 | 3/1964 | Fuller | 114/290 |
| 3,160,134 | 12/1964 | Hillman et al. | 114/66.5 |
| 3,210,783 | 10/1965 | Petty | 9/1 |
| 3,289,226 | 12/1966 | Thompson | 9/1 |
| 4,092,754 | 6/1978 | Yost | 114/361 |
| 4,672,905 | 6/1987 | Pipkorn | 114/56 |
| 4,729,334 | 3/1988 | DeJean, Jr. | 114/361 X |
| 4,742,795 | 5/1988 | DePrey et al. | 114/362 |
| 4,883,016 | 11/1989 | Larson | 114/364 |
| 4,993,340 | 2/1991 | Pepper | 114/61 |
| 5,061,215 | 10/1991 | Walls | 114/61 X |
| 5,125,352 | 6/1992 | Shields | 114/56 |
| 5,140,930 | 8/1992 | Lund | 114/291 |

FOREIGN PATENT DOCUMENTS

| | | | |
|---|---|---|---|
| 2463717 | 4/1981 | France | 114/61 |
| 1218688 | 1/1971 | United Kingdom | 114/61 |

OTHER PUBLICATIONS

Vivian Industrial Plastics, Inc. sales brochure, "VIP", Illustrating VIP Deckliner Boats.

Stratos Boats, Inc. catalog, "Stratos Boats", Illustrating 200 VT Ski Boat, p. 15, 1988.

Ozark Boat Works catalog, "Fun 'n' Sun Cruisers", 1991.

Four (4) photographs of prior art Ozark Boat Works "Fun 'n' Sun Crusier" Boats, taken Jun. 1992.

Sales brochure by JC Manufacturing Inc., "JC Excitement", prior art Tri-Toon boats.

Advantage Boats sales brochure, "Advantage 26' Party Cat LX".

Trailer Boats magazine, "There's Magic in its Style", pp. 58-60, illustrating and discussing Magic Legend 240 Boat, Mar. 1992.

Boat Journal magazine, "Center Consoles in the Keys", pp. 28-29, Jun./Jul. 1991.

Leisure Cat/Regal Marine Ind., Inc. sales brochure "Leisure Cat 26", 1992.

Photographs (12) of Marine Products' prior art Suncat 28' pontoon boat.

Powerboat Magazine, "Magic 240 Legend", 1992, illustrating prior art Magic Legend 240 Boat.

Magic Boats, Inc. sales brochure "Legend 240 by Magic", 1992, illustrating prior art Magic Legend 240 Boat.

Advertisement in Jul. 1991 issue of Boating magazine, "A Day On a Genesis is More Fun Than a Month on Any Other Boat", illustrating Genesis Boat by Wellcraft Marine, copyright 1990.

Sales Publication entitled "Hurricane", by Godfrey Marine, Elkhart, Ind. (Oct. 1990).

*Primary Examiner*—Sherman Basinger

*Attorney, Agent, or Firm*—Michael, Best & Friedrich

[57] ABSTRACT

A pontoon-type boat comprising a deck having opposite sides, and a modified tunnel hull supporting the deck and including a first outer sponson located adjacent one of the sides of the deck, a second outer sponson located adjacent the other of the sides of the deck, and a center sponson which is located and spaced between the outer sponsons, which extends substantially the entire length of the boat, and which includes a rearward portion having a maximum depth and a maximum width, and a forward portion having a maximum width greater than the maximum width of the rearward portion and having a maximum depth greater than the maximum depth of the rearward portion, the forward and rearward portions defining therebetween a step.

9 Claims, 5 Drawing Sheets 98
114
110
126
106
122
118
94
90
130
104
9
9
122
106
98
90
110
106
98
90
122

PONTOON-TYPE BOAT

BACKGROUND OF THE INVENTION

The invention relates to pontoon-type boats. A typical pontoon-type boat has a generally rectangular deck or floor supported either by actual pontoons or by a tunnel hull. The main purpose of a pontoon-type boat is carrying a large number of people. Speed is a secondary consideration. It is known, however, that a tunnel hull provides greater speed than conventional aluminum pontoons. Unlike conventional pontoons, the sponsons of a tunnel hull allow a boat to plane on top of the water. Conventional pontoons provide a semi-displacement hull that cannot get up on top of the water, although it may plane to some extent.

A standard tunnel hull has two sponsons, one on each side of the boat, with a space or tunnel in between. It is known to provide a racing tunnel hull with an additional sponson-like structure in front of the propeller. This additional structure is wedge-shaped and extends only a short distance in front of the propeller (substantially less than 50% of the length of the hull). Its purpose is to "shape" the water for the propeller.

It is also known to provide an actual pontoon boat with a motor pod, i.e., an additional downwardly extending structure in front of the propeller and between the pontoons. See, for example, U.S. Ser. No. 897,328, which was filed Jun. 11, 1992, which is titled "Motor Pod for Pontoon Boat" and which is assigned to the assignee hereof. Known motor pods extend only a short distance in front of the propeller (substantially less than 50% of the length of the boat).

It is also known to provide an actual pontoon boat (as opposed to a pontoon-type boat with a tunnel hull) with three pontoons of equal length. Because a true pontoon boat does not get on top of the water in the same way a boat with a tunnel hull does, there is no disadvantage in having the center pontoon extend all the way to the front of the boat.

Also, it is known to provide a pontoon boat with a boarding ladder that folds up on top of the deck of the boat.

SUMMARY OF THE INVENTION

Applicants' invention provides a pontoon-type boat with a modified tunnel hull. The hull includes a center sponson that extends all the way to the front of the boat, and the forward portion of the center sponson is enlarged. Applicants have recognized that if enough passengers are crowded at the bow of a pontoon-type boat with a tunnel hull, the bow may dip or become "buried" when the boat decelerates and goes off plane. In extreme situations, water can wash over the bow and onto the deck. The increased length of the center sponson and the enlarged forward portion of Applicants' boat provide additional buoyancy that substantially prevents the bow of the boat from dipping when the boat goes off plane. The increased length of the center sponson also provides a storage area beneath the deck and inside the center sponson. The enlarged forward portion of the center sponson also provides a convenient space for a bait well or other storage area.

Preferably, the forward and rearward portions of the center sponson are separated by a sharp step. Such a step produces less drag than would a more gradual transition. The step is preferably located approximately at the midpoint of the hull. Both of the forward and rearward portions of the center sponson are not as deep as the outer sponsons, so that most or all of the center sponson is out of the water when the boat is on plane.

The boat also includes a unique ladder arrangement. More particularly, the boat has a boarding ladder that folds up into a recess in the deck of the boat. The recess is covered by a door both when the ladder is being stored and when the ladder is in use. Preferably, the recess is defined by a fiberglass tub located in an opening in the deck.

Other features and advantages of the invention will become apparent to those skilled in the art upon review of the following detailed description, claims and drawings.

Figure 1:
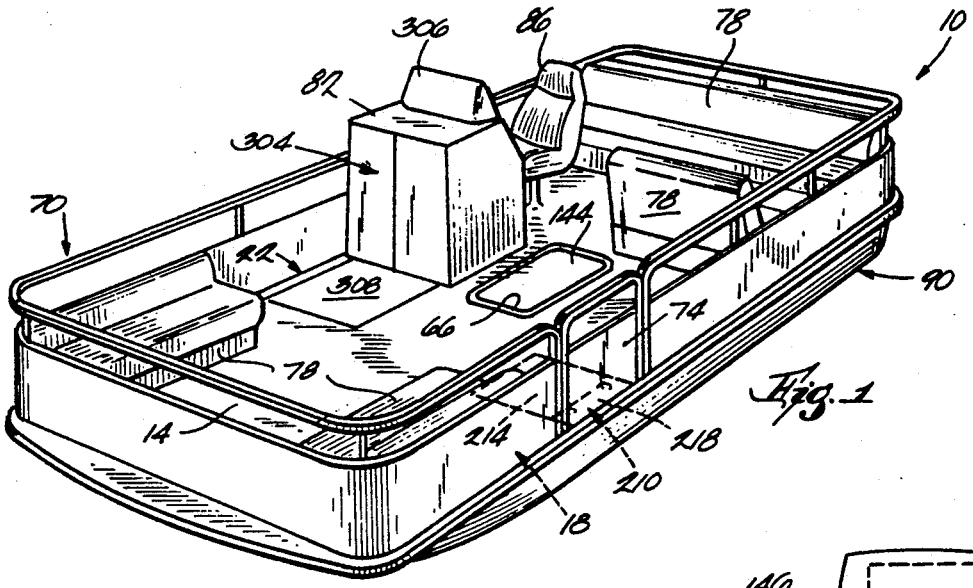
FIG. 1 is a perspective view of a boat embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A pontoon-type boat 10 embodying the invention is illustrated in the drawings.

As shown in FIGS. 1-5, the boat 10 comprises a generally rectangular deck 14 having port and starboard sides 18 and 22, respectively, and a generally horizontal upper surface 26 (see FIG. 5) The upper surface 26 has therein (see FIGS. 3 and 4) a generally rectangular opening 30. A fiberglass tub 34 is disposed in the opening 30 and defines a recess 38 in the upper surface 26 of the deck 14. The upper end of the tub 34 defines an outwardly extending lip 42 having an underside engaging the upper surface 26 of the deck 14. The upper end of the tub 34 also defines an endless, upwardly facing ledge 46. The tub 34 has fore and aft walls 50 and 54 (FIG. 3) and port and starboard walls (FIG. 4) 58 and 62. The reason for the tub 34 is explained below. The upper surface 26 of the deck 14 also has therein (see FIGS. 1 and 5) a generally centrally located opening 66. The deck 14 also has therein a recess 67 defined in part by an upwardly facing surface 68 below the upper surface 26 of the deck. The reasons for the opening 66 and recess 67 are explained below.

A railing 72 (see FIG. 1) extends upwardly from the deck 14 and surrounds the periphery of the deck 14. The railing 70 has therein, on the port side 18 of the boat 10, a door or gate 74 located immediately adjacent the tub 34. A number of passenger seats 78 are mounted on the upper surface 26 of the deck 14, along with a helm/-head console 82 and an operator's seat 86. The helm/-head console 82 is described below in greater detail.

The boat 10 also comprises a hull 90 supporting the deck 14 for movement over the water. The hull 90 is preferably a one-piece, unitary, integral, fiberglass hull. Furthermore, the hull 90 is preferably a modified tunnel hull. The hull 90 includes (see FIGS. 6, 8 and 10) a port outer sponson 94 located adjacent the port side 18 of the deck 14 and a starboard outer sponson 98 located adjacent the starboard side 22 of the deck 14. The outer sponsons 94 and 98 are substantially identical except for being mirror images of each other. Each of the outer sponsons 94 and 98 has (see FIG. 6) a forward end 102 spaced slightly rearwardly from the forward end of the hull 90, and each has (see FIG. 8) a maximum depth 104.

Figure 6:
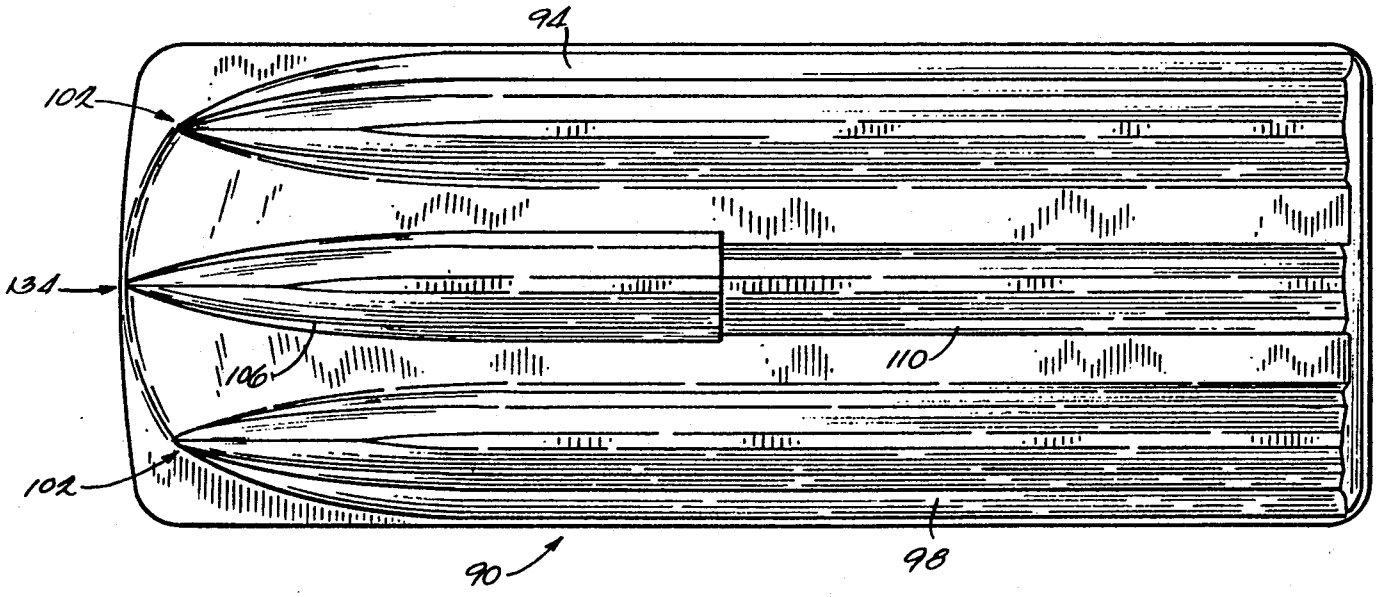
FIG. 6 is a bottom plan view of the boat.
Figure 7:
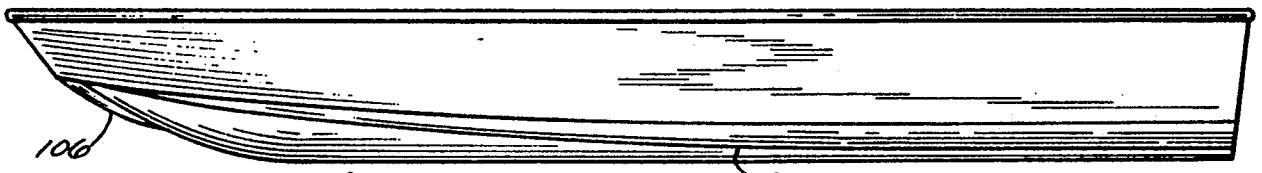
FIG. 7 is a side elevational view of the hull.
Figures 8, 9, 10:
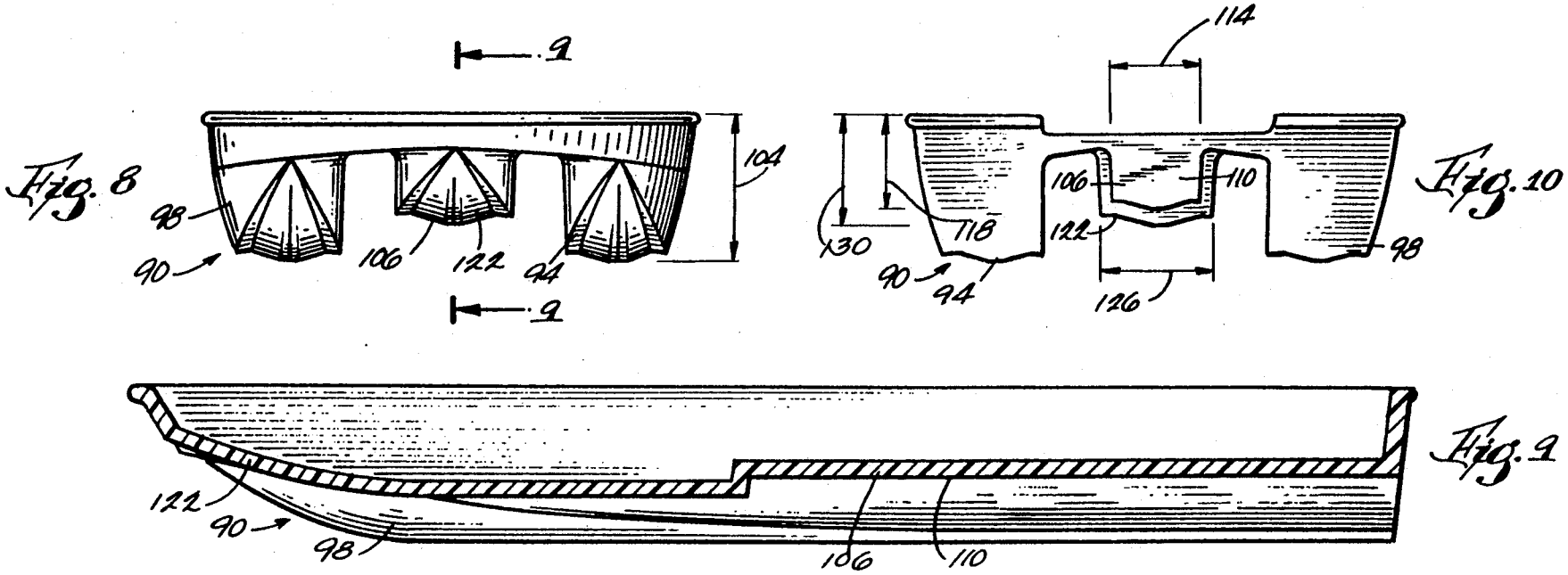
FIG. 8 is a front elevational view of the hull.
FIG. 9 is a view taken along line 9—9 in FIG. 8.
FIG. 10 is a rear elevational view of the hull.

The hull 90 also includes a center sponson 106 located and spaced between the outer sponsons 94 and 98. As shown in FIG. 6, the center sponson 106 extends substantially the entire length of the boat 10. The center sponson 106 includes a rearward portion 110 having (see FIG. 10) a maximum width 114 (at its bottom surface) and a maximum depth 118. In the illustrated construction, the width and depth of the rearward portion 110 are substantially constant along the entire length of the rearward portion 110., The center sponson 106 also includes an enlarged forward portion 122. The forward portion 122 has a maximum width 126 (at its bottom surface) greater than the maximum width 114 of the rearward portion 110 and has a maximum depth 130 greater than the maximum depth 118 of the rearward portion 110. In the illustrated construction, the width and depth of the forward portion 122 are substantially constant over approximately the rearward half of the forward portion 122. Over the forward half of the forward portion 122, the width and depth decrease toward the bow. In other words, the forward portion 122 of the center sponson 106 tapers in the forward direction so that the forward end of the center sponson 106 merges with the remainder of the hull 90. As shown in FIG. 6, the center sponson 106 has a forward end 34 located forwardly of the forward ends 102 of the outer sponsons 94 and 98. As shown in FIGS. 8 and 10, the maximum depth 130 of the center sponson 106 is less than the maximum depths 104 of the outer sponsons 94 and 98. The center sponson 106 is configured such that most or all of the center sponson 106 is out of the water when the boat 10 is on plane. Alternatively stated, at least a substantial portion of the center sponson 106 is out of the water when the boat 10 is on plane.

The center sponson 106 includes (see FIG. 5) an interior space partially defining a storage area 140, and the opening 66 in the deck 14 affords access to the storage area 140. A removable cover or hatch 144 is normally placed over the opening.

Figure 5:
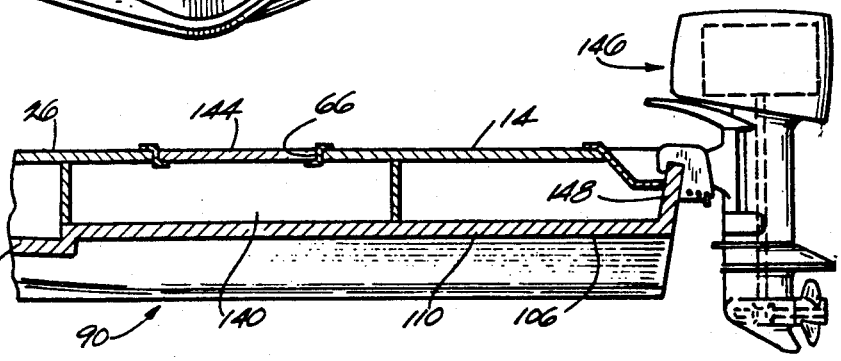
FIG. 5 is a partial side elevational view, partially cut away, of the boat.

The boat 10 is powered by (see FIG. 5) a conventional outboard motor 146 mounted on a transom portion 148 of the boat 10. As shown in FIG. 5, the transom portion 148 is formed by the aft end of the center sponson 106.

The boat 10 also comprises (see FIGS. 2 through 4) a boarding ladder 150 that can be folded up and stored inside the tub 34. The ladder 150 is shown in its stored position in broken lines in FIG. 4. The ladder 150 can be pivoted and unfolded to a boarding position (shown in solid lines in FIGS. 3 and 4) wherein the ladder 150 extends over the port side 18 of the deck 14 and into the water. The gate 74 must be open to use the ladder 150. When the ladder 150 is in its stored position, it is completely located within the recess 38 and beneath the upper surface 26 of the deck 14.

Figure 2:
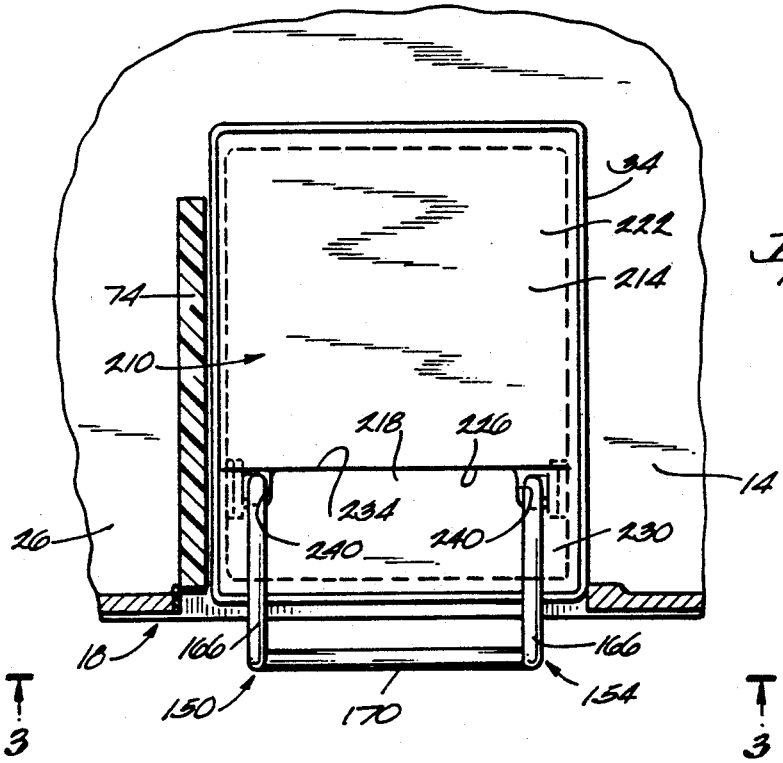
FIG. 2 is an enlarged, partial, top plan view of the boat with the boarding ladder in its boarding position.
Figure 4:
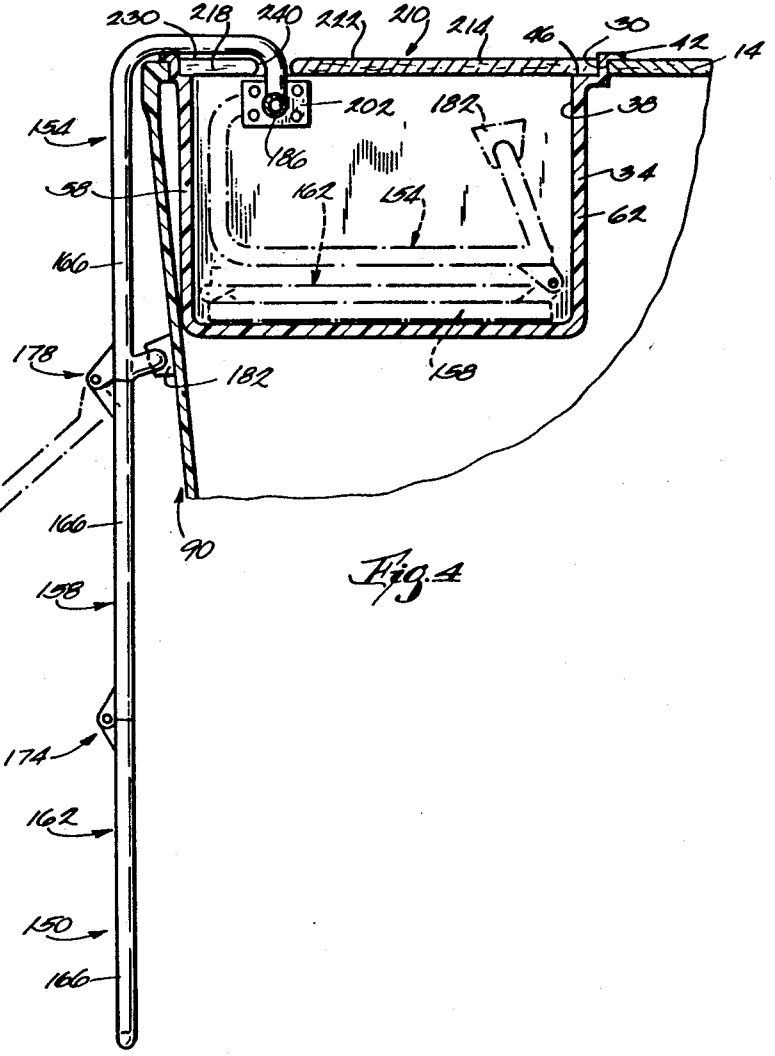
FIG. 4 is a view taken along line 4—4 in FIG. 3.
Figure 3:
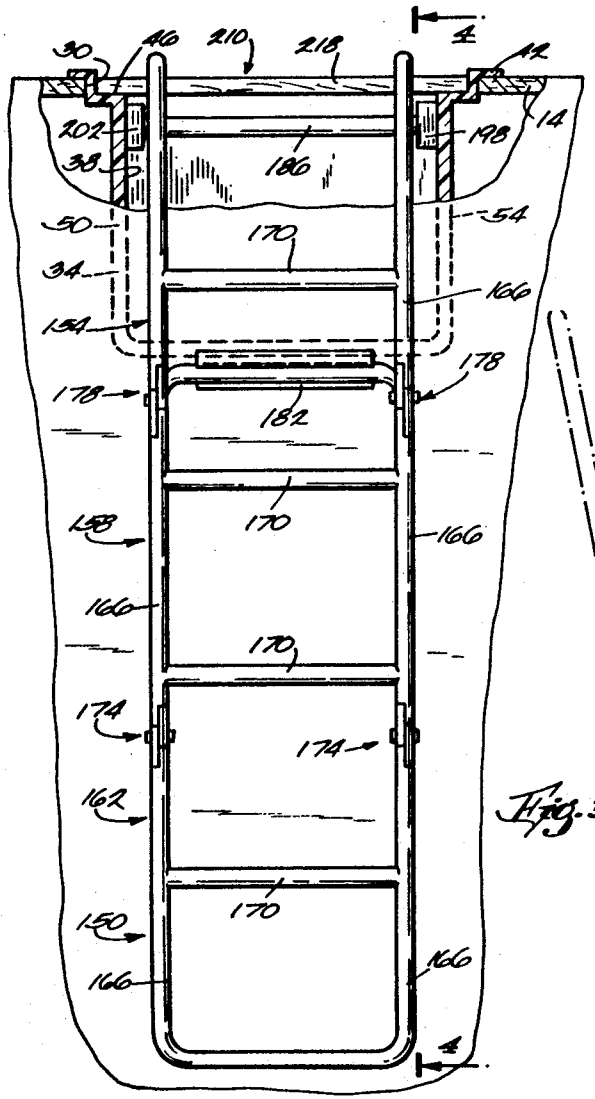
FIG. 3 is a view taken along line 3—3 in FIG. 2.

More particularly, as shown in FIGS. 2–4, the ladder 150 includes a J-shaped upper section 154 having upper and lower ends, a straight middle section 158 having upper and lower ends, and a straight lower section 162 having an upper end. Each of the ladder sections 154, 158 and 162 includes spaced side members 166 and one or more cross members 170 extending between the side members 166. The upper end of the lower section 162 is pivotally connected to the lower end of the middle section 158 by a pair of hinges 174, and the upper end of the middle section 158 is pivotally connected to the lower end of the upper section 154 by a pair of hinges 178. The lower end of the upper section 154 has extending therefrom a pad 182 which engages the hull 90 when the ladder 150 is in its boarding position. The upper end of the upper section 154 includes a cross member 156 which extends in the fore and aft direction and which has fore and aft ends. The aft end of the cross member 186 is pivotally connected to the aft wall 54 of the tub 34 by a pivot block 198 made of a suitable material such as polyethylene, and the fore end of the cross member 186 is pivotally connected to the fore wall 50 of the tub 34 by a pivot block 202 substantially identical to the pivot block 198. To move the ladder 150 from its boarding position to its stored position, the lower section 162 is pivoted 180° relative to the middle section 158 so that the lower section 162 abuts the middle section 158, and the middle section 158 is then pivoted 180° relative to the upper section 154 so that the lower and middle sections 162 and 158 are stacked against the upper section 154. Finally, the upper section 154 is pivoted approximately 270° relative to the tub 34 so that the entire ladder 150 is completely located within the tub 34 (or the recess 38) and beneath the upper surface 26 of the deck 14.

The boat 10 further comprises removable means for covering the recess 38 when the ladder 150 is in both the stored and boarding positions. Such means preferably includes a two-piece hatch or cover 210 that rests on the ledge 46 defined by the tub 34. More particularly, as best shown in FIGS. 2 and 4, the hatch 210 includes an inner portion 214 and an outer portion 218. The inner portion 214 has an upper surface 222 and an outer end surface 226 (see FIG. 2), and the outer portion 218 has an upper surface 230 and an inner end surface 234 (see FIG. 2). When the hatch 210 is covering the recess 38, the upper surfaces 222 and 230 of both hatch portions 214 and 218 are substantially coplanar with the upper surface 26 of the deck 14, and the inner end surface 234 of the outer portion 218 abuts the outer end surface 226 of the inner portion 214. The outer end surface 226 of the outer portion 218 has therein (see FIGS. 2 and 4) a pair of notches 240, and each of the notches 240 receives a respective side member 166 of the ladder upper section 154 when the ladder 150 is in its boarding position. As is apparent from viewing the drawings, it is not necessary to remove the hatch outer portion 218 when moving the ladder 150 between its boarding and stored positions. It is, however, necessary to remove the inner portion 214 of the hatch 210 in order to move the ladder 150.

Figure 11:
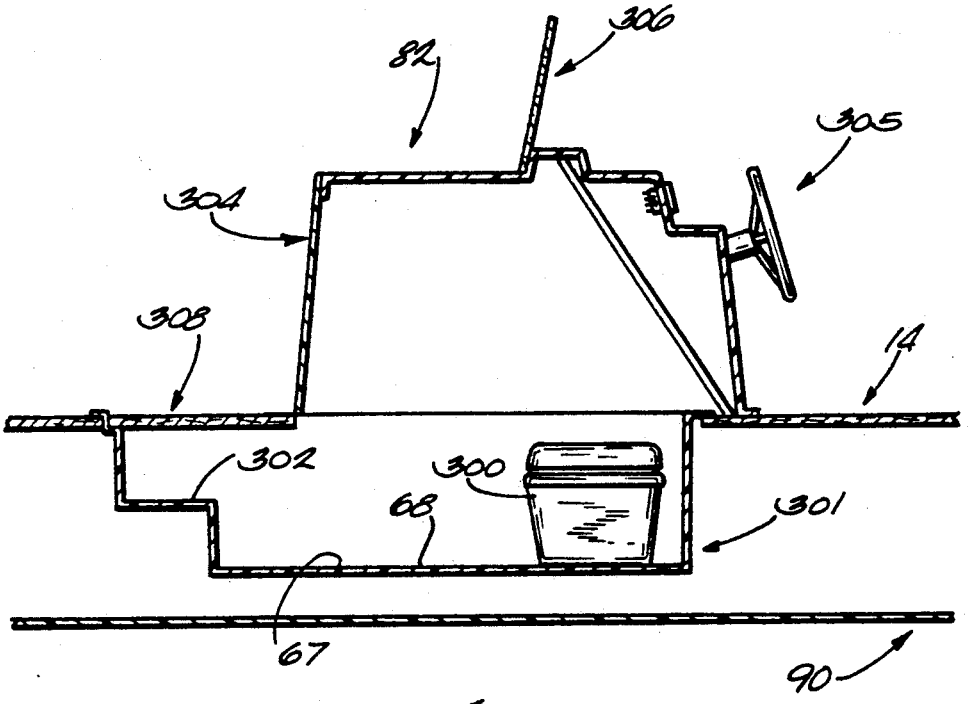
FIG. 11 is a sectional view through the helm/head console of the boat.

The boat 10 further comprises (see FIG. 11) a head 300 seated in the recess 67 and on the upwardly facing surface 68. Preferably, the recess 67 is defined by a fiberglass head well or tub 301 disposed in an opening in the deck 14. The tub 301 includes a step 302 facilitating access to the head 300. The helm/head console 82 extends above the head 300 and partially over the recess 67 to define a head compartment. The console 82 includes a door 304 affording access to the console 82 also includes a steering wheel 305 and a wind screen 306.

The boat 10 further comprises a hatch 308 which is supported by the deck, which extends over the remainder of the recess 67, and which has an upper surface 312 substantially coplanar with the upper surface 26 of the deck. The head 300 can be used with the door 304 closed and with the hatch 308 in place. This provides privacy for the user.

As used in the following claims, the term "pontoon-like structure" includes both an actual pontoon and an integral part of a hull (such as a sponson).

Various features of the invention are set forth in the following claims.

We claim:

1. A pontoon-type boat comprising a substantially planar deck having opposite sides and an upper surface and having therein a recess defined in part by an upwardly facing surface below said upper surface, said recess being located adjacent one of said sides of said deck, a head seated in said recess and on said upwardly facing surface, a step which is located in said recess, forwardly of said head, and which leads downwardly from said upper surface of said deck to said head, a helm/head console which is mounted on said deck, which is located off-center and adjacent one of said sides of said deck, which has a forwardly facing surface, and which extends above said head and partially over said recess a door which is located in said forwardly facing surface and which opens to afford access to said head, a hatch which is supported by said deck forwardly of said console, which extends over the remainder of said recess, including said step, and which has an upper surface substantially coplanar with said upper surface of said deck, and a hull supporting said deck and including a first outer sponson located adjacent one of said sides of said deck, a second outer sponson located adjacent the other of said sides of said deck, each of said outer sponsons having a forward end and a maximum depth, and said hull also including a center sponson which is located and spaced between said outer sponsons, which extends substantially the entire length of said boat and has a forward end located forwardly of said forward ends of said outer sponsons, and which includes a forward portion and a rearward portion, said rearward portion having a maximum width and a maximum depth, and said forward portion having a maximum width greater than the maximum width of said rearward portion and having a maximum depth greater than the maximum depth of said rearward portion and less than said maximum depths of said outer sponsons, such that said forward and rearward portions of said center sponson define therebetween a step.

2. A pontoon-type boat comprising a substantially planar deck having opposite sides and an upper surface and having therein a recess defined in part by an upwardly facing surface below said upper surface, a first outer pontoon-like structure which supports said deck and which is located adjacent one of said sides of said deck, a second outer pontoon-like structure which supports said deck and which is located adjacent the other of said sides of said deck, a head seated in said recess and on said upwardly facing surface, a helm/head console which is mounted on said deck and which extends above said head, said console extending only partially over said recess and including a door affording access to said head, and a hatch which is supported by said deck, which extends over the remainder of said recess, and which has an upper surface substantially coplanar with said upper surface of said deck.

3. A boat as set forth in claim 2 wherein said recess is located above one of said outer pontoon-like structure.

4. A boat as set forth in claim 2 wherein said console is located off-center and adjacent one of said sides of said deck.

5. A boat as set forth in claim 2 wherein said console has a forwardly facing surface, wherein said door is located in said forwardly facing surface, and wherein said hatch is located forwardly of said console.

6. A boat as set forth in claim 5 wherein the portion of said recess covered by said hatch contains at least one step leading downwardly from said upper surface of said deck to said head.

7. A boat comprising a substantially planar deck having opposite sides and an upper surface and having therein a recess defined in part by an upwardly facing surface below said upper surface, said recess being located adjacent one of said sides of said deck, a hull supporting said deck, a head seated in said recess and on said upwardly facing surface, a step which is located in said recess, forwardly of said head, and which leads downwardly from said upper surface of said deck to said head, a helm/head console which is mounted on said deck, which is located off-center and adjacent one of said sides of said deck, which has a forwardly facing surface, and which extends above said head and partially over said recess a door which is located in said forwardly facing surface and which opens to afford access to said head, and a hatch which is supported by said deck forwardly of said console, which extends over the remainder of said recess, including said stp, and which has an upper surface substantially coplanar with said upper surface of said deck.

8. A boat comprising a substantially planar deck having opposite sides and an upper surface and having therein a recess defined in part by an upwardly facing surface which is below said upper surface and which is adapted to support a head, a hull supporting said deck, a helm/head console, said console extending above and partially over said recess so as to form a head compartment, said console further including a door affording access to said head compartment, and a hatch which is supported by said deck, which extends over the remainder of said recess, and which has an upper surface substantially coplanar with said upper surface of said deck.

9. A boat comprising a substantially planar deck having opposite sides and an upper surface and having therein a recess defined in part by an upwardly facing surface which is below and upper surface and which is adapted to support a head, a hull supporting said deck, a head seated in said recess and on said upwardly facing surface, a step which is located in said recess, forwardly of said head, and which leads downwardly from said upper surface of said deck to said head, a helm/head console which is mounted on said deck, which has a forwardly facing surface, and which extends above said head and partially over said recess, a door which is located in said forwardly facing surface and which opens to afford access to said head, and a hatch which is supported by said deck forwardly of said console, which extends over the remainder of said recess, including said step, and which has an upper surface substantially coplanar with said upper surface of said deck.

* * * * *

UNITED STATES PATENT AND TRADEMARK OFFICE

CERTIFICATE OF CORRECTION

PATENT NO. : 5,209,177

DATED : May 11, 1993

INVENTOR(S) : Charles L. Granie and James W. Filiatreault

It is certified that error appears in the above—identified patent and that said Letters Patent is hereby corrected as shown below:

In column 3, line 1, change "72" to -- 70 --.

In column 3, line 31, change the "," to a -- . --.

In column 4, line 25, change "156", to -- 186 --.

In column 5, line 11, before "console 82", insert -- head 300. The --.

In column 6, line 23, change "structure" to -- structures --.

In column 6, line 57, change "stp" to -- step --.

In column 6, line 66, start a new sub-paragraph with "a helm/head".

In column 7, line 11, change "below and" to -- below said --.

Signed and Sealed this

Eighteenth Day of January, 1994

Attest:

Bruce Lehman

BRUCE LEHMAN

Attesting Officer

Commissioner of Patents and Trademarks